US008888327B1

(12) United States Patent
Baldwin et al.

(10) Patent No.: US 8,888,327 B1
(45) Date of Patent: Nov. 18, 2014

(54) HALOGEN LAMPHOLDER AND HALOGEN LAMPHOLDER WITH HEAT SHIELD

(75) Inventors: Jeffrey P. Baldwin, Pheonix, AZ (US); Richard L. Cleghorn, Tempe, AZ (US); Marcus J. Shotey, Scottsdale, AZ (US)

(73) Assignee: Hubbell Incorporated, Shelton, CT (US)

( * ) Notice: Subject to any disclaimer, the term of this patent is extended or adjusted under 35 U.S.C. 154(b) by 946 days.

(21) Appl. No.: 12/818,008

(22) Filed: Jun. 17, 2010

Related U.S. Application Data

(60) Provisional application No. 61/187,992, filed on Jun. 17, 2009, provisional application No. 61/224,351, filed on Jul. 9, 2009.

(51) Int. Cl.
*F21V 29/00* (2006.01)

(52) U.S. Cl.
USPC ..... 362/264; 362/294; 362/345

(58) Field of Classification Search
USPC ..... 362/373, 345, 264, 218, 294, 296.05; 445/23
See application file for complete search history.

(56) References Cited

U.S. PATENT DOCUMENTS

| | | | | |
|---|---|---|---|---|
| 6,030,095 | A * | 2/2000 | Moore et al. | 362/645 |
| 7,494,252 | B1 * | 2/2009 | Thornton et al. | 362/294 |
| 2001/0019483 | A1 * | 9/2001 | Takada | 362/517 |
| 2008/0232095 | A1 * | 9/2008 | Canella | 362/158 |
| 2010/0103678 | A1 * | 4/2010 | Van De Ven et al. | 362/294 |
| 2011/0051424 | A1 * | 3/2011 | Balazs et al. | 362/294 |

* cited by examiner

*Primary Examiner* — Anh Mai
*Assistant Examiner* — Zachary J Snyder
(74) *Attorney, Agent, or Firm* — Alan I. Cantor; Mark S. Bicks; Alfred N. Goodman

(57) ABSTRACT

A lamp assembly comprising a housing having a front surface, a cavity, and a mounting rod, a reflector having an opening and mounted within the cavity, a light source removably mounted within the cavity and the opening, a cap removably secured to the housing, a lens disposed between the cap and the housing, a heat shield, and wherein the heat shield is disposed between the lens and the light source.

19 Claims, 5 Drawing Sheets

HALOGEN LAMPHOLDER AND HALOGEN LAMPHOLDER WITH HEAT SHIELD

CROSS REFERENCE TO RELATED APPLICATIONS

This Application claims the benefit of the filing date of U.S. Provisional Patent Application 61/187,992 to Shotey et al. entitled "Heat Shield for Halogen Lampholders" which was filed on Jun. 17, 2009 and U.S. Provisional Patent Application 61/224,351 to Shotey et al. entitled "Halogen Lampholder" which was filed on Jul. 9, 2009, the disclosures of which are hereby incorporated herein by reference.

BACKGROUND OF THE INVENTION

1. Technical Field

Aspects and implementations of this document relate generally to lamp holders. Particular implementations include lamp holders designed to reduce excessive heat build-up within the lamp holder to increase the bulb life and reduce hot spots on the lens to prevent cracking or breakage of the lens.

2. Background Art

Lamp holders of various forms are well known in the electrical lighting art aspects of construction and retail replacement by consumers. Traditional lamp holders designed for halogen bulbs consist of a grounded bulb mount adapted to receive the halogen bulb and a reflector within the lamp holder. A lens is used to protect the halogen bulb from the environmental elements, however the enclosed structure of the reflector and lens creates a great deal of heat that can prematurely wear the bulb or the lens. Therefore, it is desirable to reduce the heat within the lamp holder while increasing the bulb and lens longevity.

There are multiple variations of lamp holder designs known in the art including designs that accommodate any number of bulb types and incorporate any number of final installation adjustments. While the size and shape of the lamp holder may vary depending on the desired lamp output, issues with overheated bulbs and cracking lens continue to plague lamp holder designs.

SUMMARY

This disclosure includes one or more lamp holder designs that do not impact the bulb output, capabilities, or features, but allow for increased bulb life and lamp holder stability. A particular implementation employs a heat shield with a dual parabolic reflector which is designed prevent hot spots on the lens while also spreading the bulb intensity throughout the lens and lamp holder housing.

A particular embodiment broadly comprises a lamp assembly comprising a housing having a front surface, a cavity, and a mounting rod, a reflector having an opening and mounted within the cavity, a light source removably mounted within the cavity and the opening, a cap removably secured to the housing, a lens disposed between the cap and the housing, a heat shield, and wherein the heat shield is disposed between the lens and the light source.

In particular implementations, a lamp holder assembly may comprise one or more of the following features. The heat shield may be located between the lens and the reflector. The heat shield may further comprise a central portion aligned with the light source. The central portion may be disk shaped. The heat shield may further comprise an upper flange and a lower flange with a pair of legs connecting the upper flange to the central portion and a second pair of legs connecting the lower flange to the central portion. The central portion may also prevent heat generated by the light source from directly impacting a central section of the lens. Further, heat impacting the central portion may be dissipated through the first and second pair of legs and the upper and lower flanges. The upper and lower flanges may transfer heat into the cap.

In particular implementations, a lamp holder assembly reflector may be parabolic in shape. The reflector may further comprise a mid-point between the opening and the front surface of the housing, wherein the light source extends proximate the mid-point. The reflector may also further comprise a parabolic portion and a cylindrical portion and wherein the light source is maintained within an area surrounded by the parabolic portion. The lens may be ceramic. The light source and the lens may each further comprise a longitudinal axis and wherein the light source longitudinal axis is arranged generally perpendicular to the lens longitudinal axis. The housing may be pivotably secured to the mounting rod. A gasket may be disposed between the housing and the cap and wherein the heat shield is at least partially disposed within the gasket. The heat shield may cover approximately 25% of the lens.

Another particular embodiment broadly comprises a lamp assembly comprising a housing having a front surface, a cavity, and a mounting rod, a reflector mounted within the cavity and having a first parabolic portion with an opening and a second portion closer to the front surface than the first parabolic portion, a light source removably mounted within the cavity and the opening, a cap removably secured to the housing, a lens disposed between the cap and the housing, and wherein the second portion is generally cylindrical in shape.

In particular implementations, a diameter of the second portion increases from the first portion to the front surface. Further, a heat shield may be disposed between the lens and the light source.

Still another particular embodiment broadly comprises a method of assembling a lamp holder comprising the steps of providing a housing with a front surface and a cavity, inserting a reflector within the cavity and behind the front surface, installing at least a portion of a heat shield having a central portion within a gasket, inserting a lens within an inner portion of a cap, mounting the gasket within the cap inner portion with the heat shield central portion adjacent the lens, and coupling the cap with the housing at the front surface.

Aspects and applications presented here are described below in the drawings and detailed description. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

The foregoing and other aspect, features, and advantages will be apparent to those artisans of ordinary skill in the art from the DETAILED DESCRIPTION, BRIEF DESCRIPTION OF THE DRAWINGS, and from the CLAIMS.

BRIEF DESCRIPTION OF THE DRAWINGS

Features of particular embodiments and implementations of lamp assemblies will hereinafter be described in conjunction with the appended drawings, where like designations denote like elements, and.

DETAILED DESCRIPTION

At the outset, it should be appreciated that like drawing numbers on different views identify identical, or functionally similar, structural elements. While the present inventions may be described with respect to what is presently considered to be the preferred embodiments, it is to be understood that the invention as claimed is not limited to the disclosed aspects.

This disclosure, its aspects and implementations, are not limited to the specific components or assembly procedures disclosed herein. Many additional components and assembly procedures known in the art consistent with the intended lamp holders and/or assembly procedures for lamp holders may be used and will become apparent for use with particular implementations from this disclosure. Accordingly, for example, although particular implementations are disclosed, such implementations and implementing components may comprise any shape, size, style, type, model, version, measurement, concentration, material, quantity, and/or the like as is known in the art for such lamp holders and implementing components, consistent with the intended operation and purpose of lamp holders. As used herein, "lamp holders" is intended to specifically refer to the light source holders that can be mounted on a wall structure and may be adjustable by the installer to focus light on a particular area.

Figure 2:
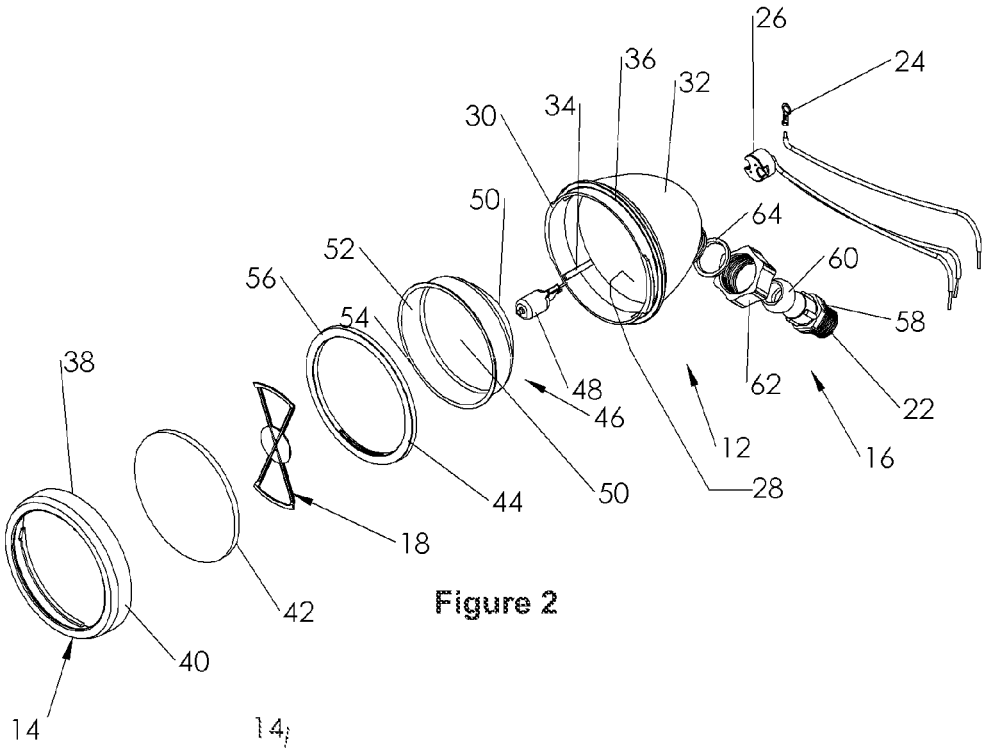
FIG. 2 is an exploded view of the lamp holder of FIG. 1.
Figure 1:
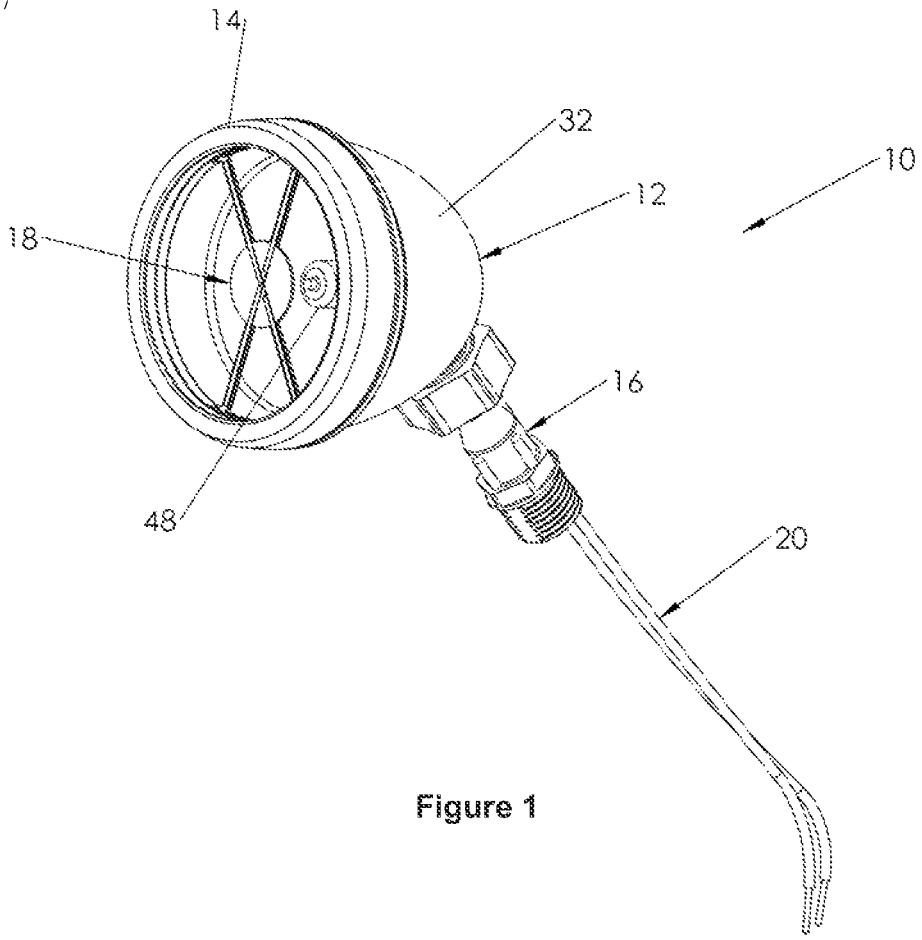
FIG. 1 is a perspective view of a particular embodiment lamp holder fully assembled with a heat shield and parabolic reflector.

Accordingly, there are a variety of lamp holder implementations. FIGS. 1 and 2 illustrate a particular embodiment lamp holder 10 with a housing 12, a cap 14, a mounting rod 16, and a heat shield 18 in the assembled state. A plurality of wires 20 may extend through a channel 22 in mounting rod 16. Wires 20 may also include a grounding mount 24 and a light source mount 26 both of which are secured within a cavity 28. Cavity 28 is formed in housing 12 and extends forward until at least a front surface 30 of housing 12. Cavity 28 is also confined by a rear portion 32 of housing 12 which is generally concave in shape. A plurality of guides 34 may be disposed within cavity 28 along the inner periphery to align the internal components (discussed below) within the housing.

Further, housing 12 may also include a threaded area 36 adapted to receive an inner threaded area 38 of cap 14 when fully assembled. Cap 14 may also include a rearwardly extending ledge 40 which functions to at least partially surround a lens 42, heat shield 18, and a gasket 44. Lamp assembly 10 also includes a reflector 46 and a light source 48. Reflector 46 includes a parabolic portion 50 and a second portion 52 terminating at a forward end 54. In a particular embodiment, forward end 54 is axially aligned with and approximately flush with front surface 30 of housing 12.

As illustrated particularly in FIG. 2, light source 48 is inserted within cavity 28 until mounted within light source mount 26. Reflector 46 is located within cavity 28 and at least partially surrounds light source 48. Heat shield 18 may be located adjacent a front face 56 of gasket 44 and lens 42. The gasket, heat shield, and lens are then inserted within an area defined by ledge 40 of cap 14. While a particular embodiment gasket, heat shield, and lens are all located within cap 14 prior to installation, the gasket, heat shield, and lens may also rest against front surface 30 or within cavity 28 and achieve the same results.

Figure 5:
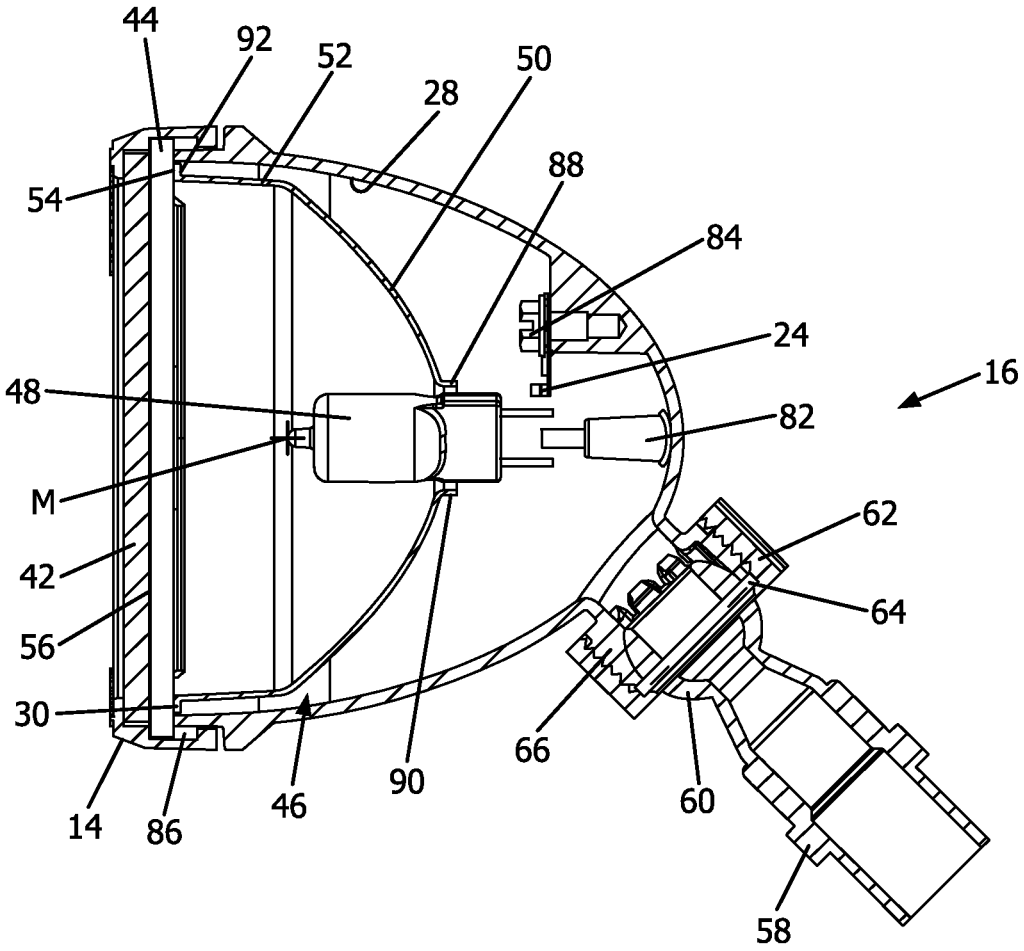
FIG. 5 is a sectional view of the lamp holder assembly.

Mounting rod 16 may include a stalk 58 having a ball socket 60 on a first end and a threaded end on a second end. The threaded end may be used to secure the lamp assembly to a structure, while ball socket 60 is arranged to be secured between housing 12 and a mounting nut 62 and a washer 64. For example, ball socket 60 may be inserted within mounting nut 62 and at least partially held in place with washer 64. Washer 64 helps maintain ball socket 60 within mounting nut 62 and the mounting nut can then be threadably engaged with housing 12 at a mount 66 (seen in FIG. 5). Although any swivel joint may be used in combination with the other features disclosed herein, another example of the ball socket illustrated in FIG. 5 is disclosed in U.S. Pat. No. 7,695,170, the disclosure of which is hereby incorporated herein by this reference.

Figure 3:
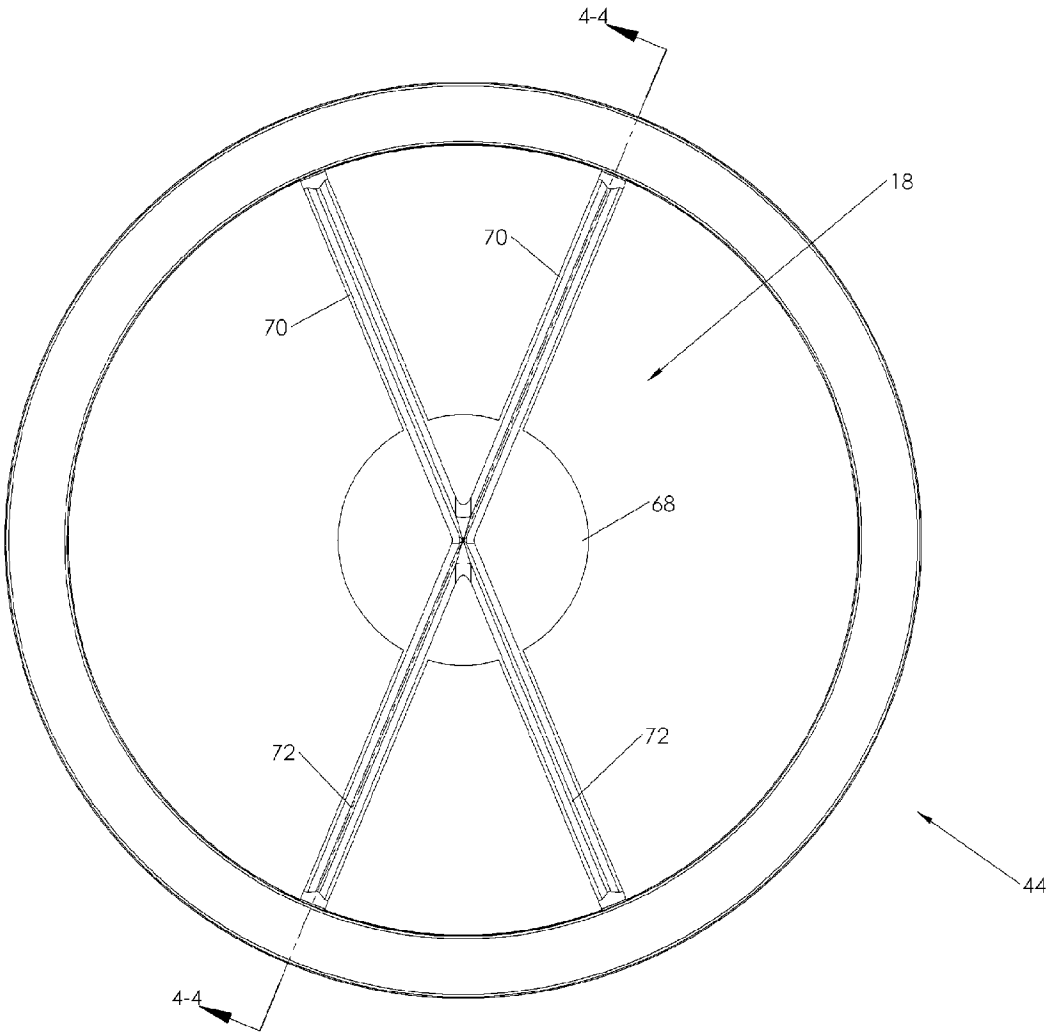
FIG. 3 is a front elevation view of the heat shield secured within a gasket prior to installation within the lamp holder.
Figure 4:
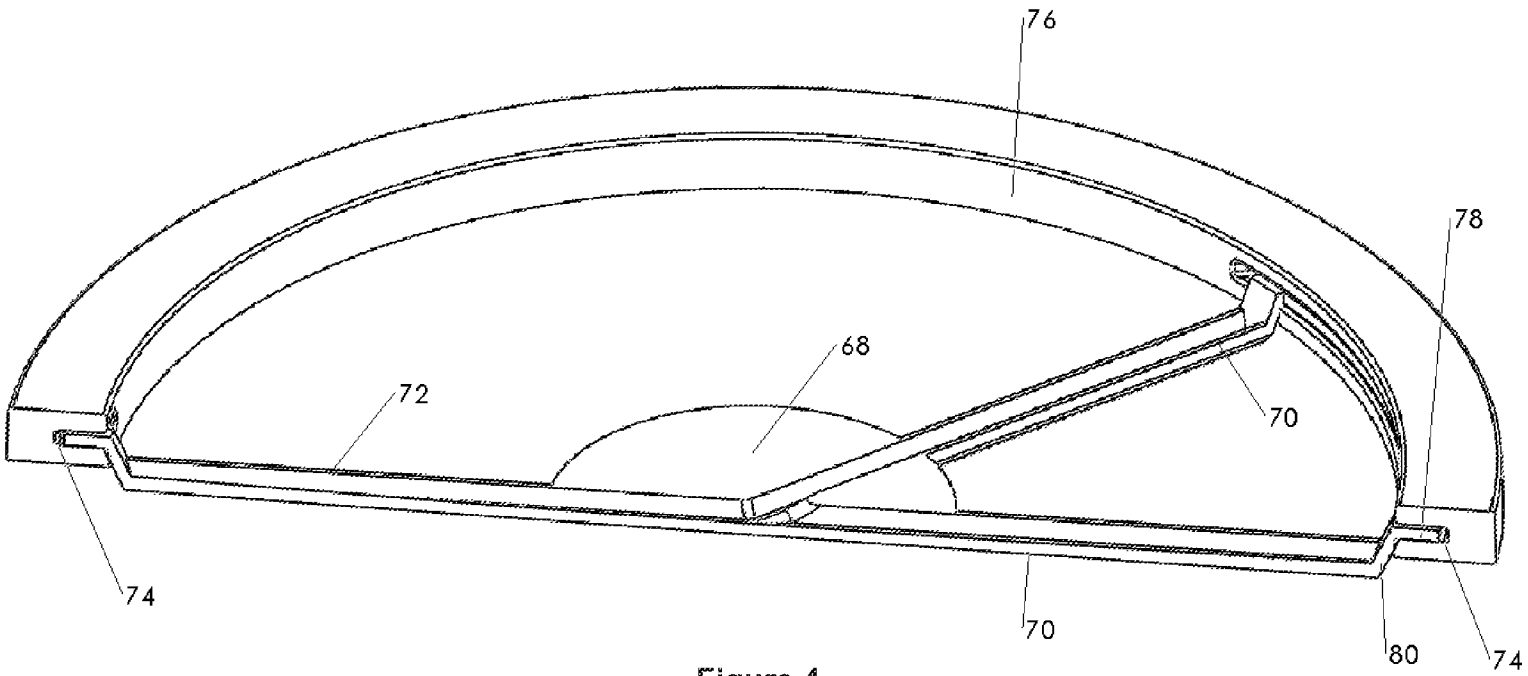
FIG. 4 is sectional view taken generally about line 4-4 in FIG. 3.

Referring now to FIGS. 3 and 4, a particular embodiment heat shield 18 is shown secured within gasket 44. Heat shield 18 may include a central portion 68 having a diameter approximately equal to 25% of lens 42, but may be any suitable size. A first pair of legs 70 and a second pair of legs 72 extend outward from central portion 68 and each form a generally "V" shape. For example, first pair of legs 70 together form a first "V" shape, while second pair of legs 72 together form a second "V" shape. Central portion 68 of heat shield 18 blocks the light from light source 48 from contacting the middle of lens 42 which is positioned on the other side of heat shield 18 from the light source 48, and thereby prevents a central hot spot on the lens 42 while light is also transmitted around the central portion to provide the necessary visible light. Still further, legs 70 and 72 help reduce the heat at lens 42 by dissipating heat from central portion 68 into cap 14. For the particular embodiment shown in FIGS. 3 and 4, each of the pairs of legs 70 and 72 includes a groove that extends its length and to the center of the central portion 68. This is a structural advantage and simplifies manufacturing of the legs 70, 72 and central portion 68, but is not a requirement of every embodiment.

Heat shield 18 (FIG. 3) may be stamped or cast as a single piece or the first and second legs may be attached to central portion 68 by any suitable means, including but not limited to welding, adhesive, or fasteners. Still further, heat shield 18 may be formed from aluminum, steel, a high density plastic, or any other suitable material capable of withstanding the heat produced. While a particular embodiment has been illustrated and described as being formed during a stamping or casting operation and composed of aluminum, any suitable manufacturing process may be utilized and my incorporate a variety of materials known to those skilled in the art.

Gasket 44 may be sized to have a diameter slightly larger than heat shield 18 so that the gasket encompasses at least the entire circumference of the heat shield. Gasket 44 may be a traditional gasket known in the art with notches. Notches 74 may be formed in an inner surface 76 of gasket 44. Notches 74 extend a length slightly larger than a flange 78 of heat shield 18 to tightly contain heat shield 18 and particularly flange 78 of heat shield 18 within gasket 44. Flange 78 is formed in heat shield 18 and adjacent a step 80 of heat shield 18. Step 80 permits legs 70 and 72 to be offset from gasket 44 and thereby locate central portion 68 closer to lens 42. As illustrated particularly in FIGS. 3-5, the step 80 may also space the central portion 68 further away from the lens 42. Thus, heat shield 18 may include central portion 68, legs 70 and 72 each having step 80 and terminating in flange 78. Once again, while a step 80 and flange 78 are shown and described, a flat heat shield is also envisioned and within the scope of this particular embodiment.

Referring to FIG. 5, a cross-sectional view of a particular embodiment lamp holder assembly 10 is shown with wiring components removed for clarity. A light source mount stud 82 may be formed within cavity 28 and is used to locate light source mount 26, while a screw 84 is utilized to connect grounding mount 24 within cavity 28. Still further, housing 12 may also include a receiving notch 86 adapted to secure cap 14 to the housing.

As discussed above, reflector 46 may include a parabolic portion 50 and a second portion 52 that is distinct from the parabolic portion 50. Parabolic portion 50 may also include an opening 88 at least partially defined by tabs 90 for receiving light source 48 there through. Second portion 52 may include a ledge 92 arranged to contact gasket 44 when fully installed. Ledge 92 helps position and locate the reflector with respect to cap 14 and cavity 28. The second portion 52 may be cylindrical or generally cylindrical (having less than 10 degrees of slope) so that the reflector 46 comprises a compound shape, not simply a cone and not simply a parabola. It has been found that the use of a compound shape significantly reduces the amount of heat generated.

In a particular embodiment, parabolic portion 50 extends to approximately a mid-point M along the length of reflector 46 and second portion 52 extends from approximately the mid-point M to front surface 30. Further, light source 48 may be located wholly within an area defined by the parabolic portion 50 to increase the distance between light source 48 and lens 42.

Parabolic portion 50 may be sized and shaped to evenly distribute both light and heat from light source 48 on lens 42 (FIG. 2). Further, second portion 52 is sized and shaped to prevent light and heat from directly impacting a central portion of lens 42. Advantageously, the combination of the parabolic portion and the second portion help ensure that the lens receives an even distribution of heat from the light source. For example, testing has shown that a compound parabolic reflector (having parabolic portion 50 and second portion 52) can reduce the temperature at a central portion of the lens by as much as 150 degrees or more. Still further, the addition of heat shield 18 may further decrease the operating temperature at the lens by another 100 degrees or more.

Figure 6:
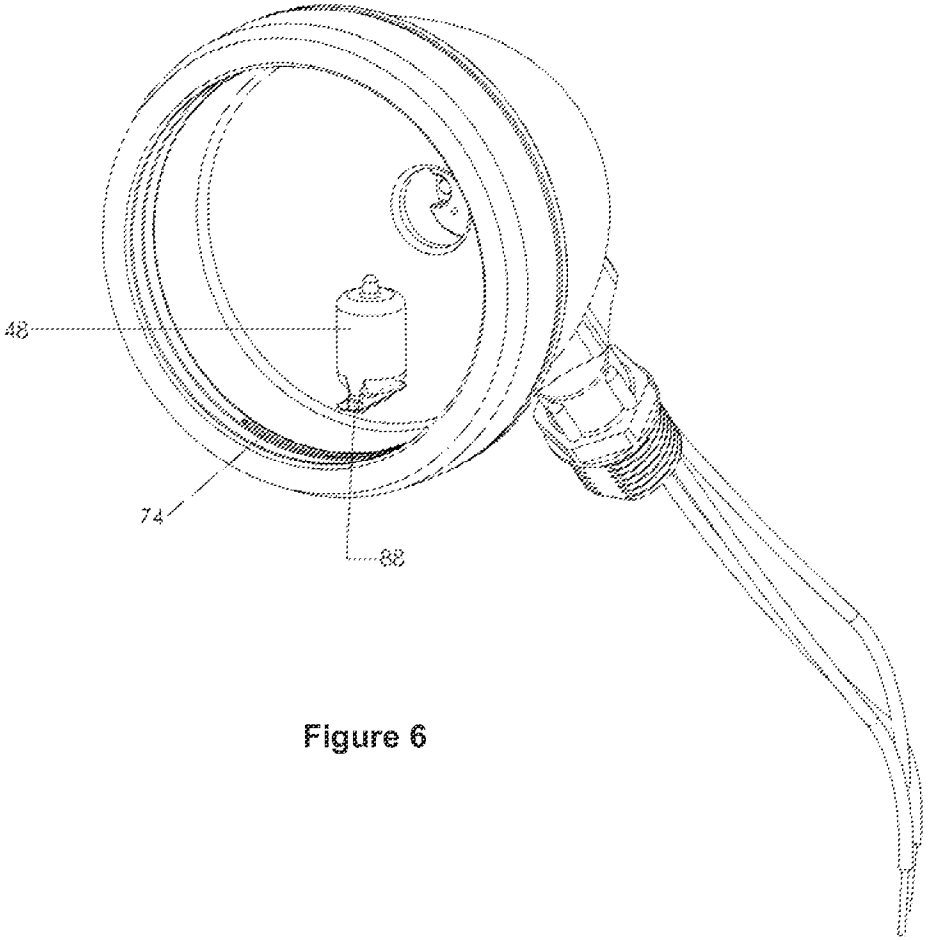
FIG. 6 is a perspective view of another particular embodiment lamp holder fully assembled.

FIG. 6 illustrates another particular embodiment with the heat shield removed. In this embodiment, opening 88 is located in a side wall of reflector 46 instead of in a rear portion of the reflector. Accordingly, light source 48 and lens 42 may each have a longitudinal axis which are arranged generally perpendicular to one another and the light source is generally perpendicular to its traditional orientation. This arrangement directs heat into the reflector instead of at the lens. Nevertheless, a heat shield, a traditional reflector, or a parabolic reflector may be incorporated.

Still other embodiments may include a light source of significantly shorter length such that the light source is contained within parabolic portion 50. The increased distance between light source 48 and lens 42 will further increase the lamp holder performance, light source life, and lens life by significantly reducing the internal temperature by as much as 100 degrees or more.

The concepts disclosed herein are not limited to the specific implementations shown herein. For example, implementations of lamp holders, and implementing components, may be formed of any of many different types of materials or combinations thereof that can readily be formed into shaped objects provided that the materials selected are consistent with the intended operation of electrical box implementations. For example, the components may be formed of: polymers such as thermoplastics (such as ABS, Fluoropolymers, Polyacetal, Polyamide; Polycarbonate, Polyethylene, Polypropylene (low or high density), Polysulfone, and/or the like), thermosets (such as Epoxy, Phenolic Resin, Polyimide, Polyurethane, Silicone, and/or the like), any combination thereof, and/or other like materials; composites and/or other like materials; metals and/or other like materials; alloys and/or other like materials; any other suitable material; and/or any combination of the foregoing thereof. Also, appropriate mounting fasteners, hardware and components may be provided. Those of ordinary skill in the art will readily be able to select appropriate materials and manufacture these products from the disclosures provided herein.

Furthermore, the lamp holder, reflectors, heat shield, and any other components forming any particular implementation of a lamp holder may be manufactured simultaneously or separately and integrally joined with one another, while other components may be pre-manufactured or manufactured separately and then assembled with the integral components. Various implementations may be manufactured using conventional procedures as added to and improved upon through the principles described here. Accordingly, manufacture of these components separately or simultaneously may involve extrusion, vacuum forming, injection molding, blow molding, casting, forging, cold rolling, milling, drilling, reaming, turning, grinding, stamping, pressing, cutting, bending, welding, soldering, hardening, riveting, punching, and/or the like. Components manufactured separately may then be coupled or removably coupled with the other integral components, if necessary, in any manner, such as with adhesive, a weld joint, a solder joint, a fastener (e.g. a bolt, a bolt and a nut, a screw, a rivet, a pin, and/or the like), washers, retainers, any combination thereof, and/or the like for example, depending on, among other considerations, the particular material forming the components. Other possible steps might include sand blasting, polishing, powder coating, zinc plating, anodizing, hard anodizing, and/or painting the components for example.

One particular benefit that may be found in particular implementations of lamp holders disclosed in this document is the value added from the increased bulb life and an increased lens life. Still further, the appearance of the lamp holder will better withstand degradation due to lower internal temperatures.

The invention claimed is:

1. A lamp assembly comprising:

a housing having a front surface, a cavity, and a mounting rod;

a reflector mounted within the cavity, the reflector having a first portion with an opening and a second portion closer to the front surface than the first portion;

a halogen light source removably mounted within the cavity, the opening, and the reflector;

a cap removably secured to the housing;

a lens separate from the reflector and removably disposed between the cap and the housing; and a heat shield disposed between the lens and the light source.

2. The lamp assembly of claim 1 wherein the heat shield is located between the lens and the reflector.

3. The lamp assembly of claim 1 wherein the heat shield further comprises a central portion aligned with the light source.

4. The lamp assembly of claim 3 wherein the central portion is disk shaped.

5. The lamp assembly of claim 3 wherein the heat shield further comprises an upper flange and a lower flange with a first pair of legs connecting the upper flange to the central portion and a second pair of legs connecting the lower flange to the central portion.

6. The lamp assembly of claim 3 wherein the central portion prevents heat generated by the light source from directly impacting a central section of the lens.

7. The lamp assembly of claim 5 wherein heat generated by the light source and impacting the central portion is dissipated through the first and second pair of legs and the upper and lower flanges.

8. The lamp assembly of claim 7 wherein the upper and lower flanges transfer heat into the cap.

9. The lamp assembly of claim 1 wherein the first portion of the reflector is parabolic in shape.

10. The lamp assembly of claim 1 wherein the reflector further comprises a midpoint along the length of the reflector between the opening and the front surface of the housing, wherein the light source extends proximate the mid-point.

11. The lamp assembly of claim 1 wherein the first portion of the reflector is parabolic in shape and the second portion of the reflector is cylindrical in shape and wherein the light source is maintained within an area surrounded by the parabolic portion.

12. The lamp assembly of claim 1 wherein the lens is ceramic.

13. The lamp assembly of claim 1 wherein the light source and the lens each further comprise a longitudinal axis and wherein the light source longitudinal axis is arranged generally perpendicular to the lens longitudinal axis.

14. The lamp assembly of claim 1 wherein the housing is pivotably secured to the mounting rod.

15. The lamp assembly of claim 1 further comprising a gasket disposed between the housing and the cap and wherein the heat shield is at least partially disposed within the gasket.

16. The lamp assembly of claim 1 wherein the heat shield covers at least approximately 25% of the lens.

17. A lamp assembly comprising:

a housing having a front surface, a cavity, and a mounting rod;

a reflector mounted within the cavity and having a first parabolic portion with an opening and a second portion closer to the front surface than the first parabolic portion;

a halogen light source removably mounted within the cavity, the opening, and the reflector;

a cap removably secured to the housing;

a lens separate from the reflector and removably disposed between the cap and the housing; and a heat shield disposed between the lens and the light source, wherein the second portion is generally cylindrical in shape.

18. The lamp assembly of claim 17 wherein a diameter of the second portion increases from the first portion to the front surface.

19. The lamp assembly of claim 1 wherein the heat shield comprises a step spacing the heat shield from the lens.

* * * * *